United States Patent [19]

Arbuckle

[11] 4,174,759

[45] Nov. 20, 1979

[54] ROTARY DRILL BIT AND METHOD OF FORMING BORE HOLE

[76] Inventor: Donald P. Arbuckle, 1203 18th St., Golden, Colo. 80401

[21] Appl. No.: 834,656

[22] Filed: Sep. 19, 1977

[51] Int. Cl.[2] ..... E21B 7/18

[52] U.S. Cl. ..... 175/67; 175/340; 175/393; 175/422; 299/17

[58] Field of Search ..... 175/67, 339, 340, 393, 175/422; 299/17

[56] References Cited

U.S. PATENT DOCUMENTS

| | | | |
|---|---|---|---|
| 2,901,223 | 8/1959 | Scott | 175/340 |
| 3,417,829 | 12/1968 | Acheson et al. | 175/67 |
| 3,542,142 | 11/1970 | Hasiba | 175/422 X |
| 3,865,202 | 2/1975 | Takahashi et al. | 175/67 X |
| 3,923,109 | 12/1975 | Williams, Jr. | 175/340 |
| 3,923,109 | 12/1975 | Williams, Jr. | 175/340 |

FOREIGN PATENT DOCUMENTS

| | | | |
|---|---|---|---|
| 39860 | 7/1957 | Poland | 175/340 |

*Primary Examiner*—Stephen J. Novosad
*Assistant Examiner*—Nick A. Nichols, Jr.
*Attorney, Agent, or Firm*—Crandell & Polumbus

[57] ABSTRACT

Means for emitting high-pressure jets of fluid such as water, and mechanical rock breaking wheels, are positioned on a rotary drill bit for cooperatively cutting an axially extending bore hole through earth material. A center core opening is cut into the drill face material of the bore hole by a jet of fluid crossing the axis of the bore hole at an acute angle. The material of the drill face annularly surrounding the center core opening is removed by cutting concentric slots in the material and by applying radially inward directed force for breaking each ring defined by the slots cut. At any given axial position or level, the slots are cut and the rings are broken in sequence from the radially innermost position to the radially outermost position of the bore hole. Removal of the drill face material occurs simultaneously at different axial positions or levels in the bore hole; the center core opening is first opened by the center jet cutting at the most axially advanced position, an inner annular segment of drill face material surrounding the center core is simultaneously removed at intermediate axial positions, and an outer annular segment of drill face material surrounding the inner annular segment is simultaneously removed at the least axially advanced positions. The fluid jet emitting means cut slots in the inner and outer annular segments. Breaker wheels break the rings of material by applying a bending movement on the rings. The jet emitting means are positioned radially adjacent the breaker wheels.

82 Claims, 12 Drawing Figures

AXIAL LEVEL
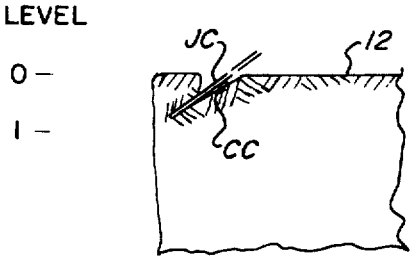
Fig_12-A
CONE II PASSES REFERENCE
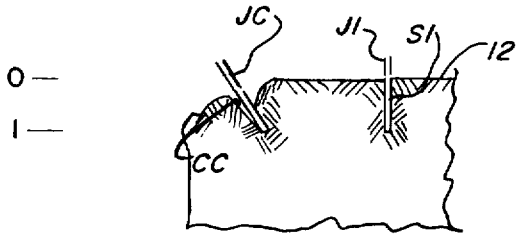
Fig_12-B
CONE III PASSES REFERENCE
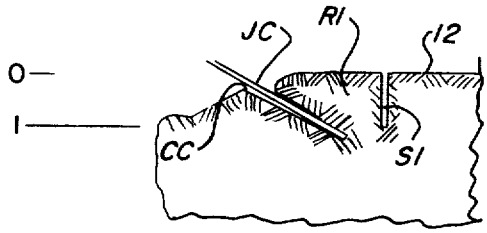
Fig_12-C
CONE II PASSES OPPOSITE REFERENCE
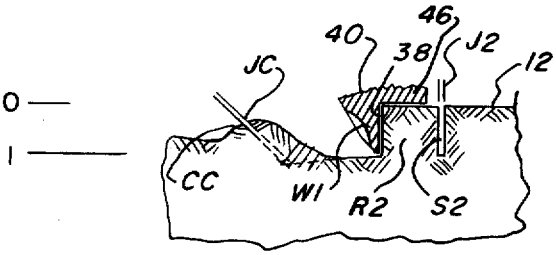
Fig_12-D
CONE I PASSES REFERENCE
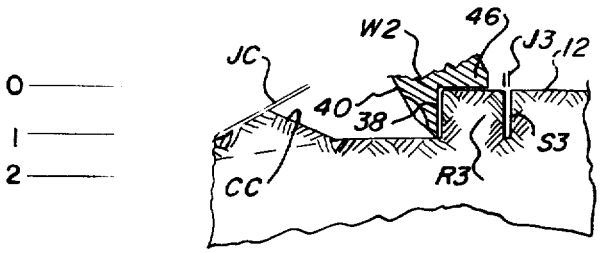
Fig_12-E
CONE II PASSES REFERENCE
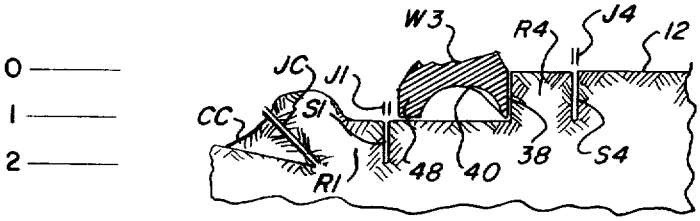
Fig_12-F
CONE III PASSES REFERENCE

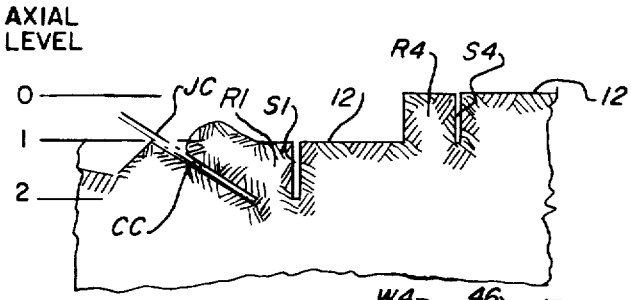
Fig_12-G
CONE II PASSES OPPOSITE REFERENCE
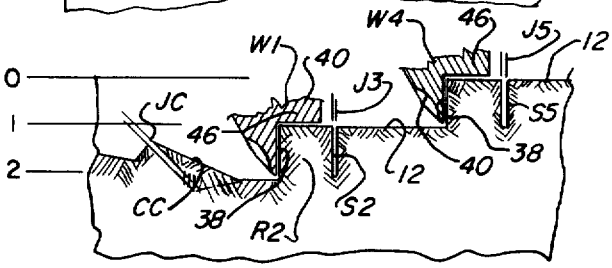
Fig_12-H
CONE I PASSES REFERENCE
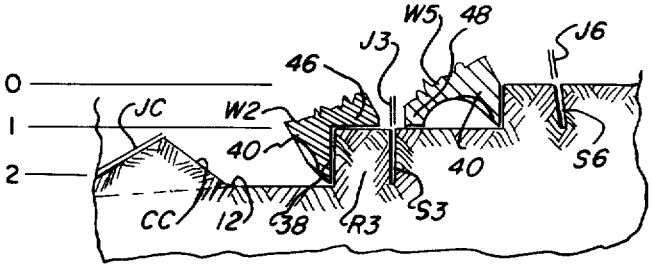
Fig_12-I
CONE II PASSES REFERENCE
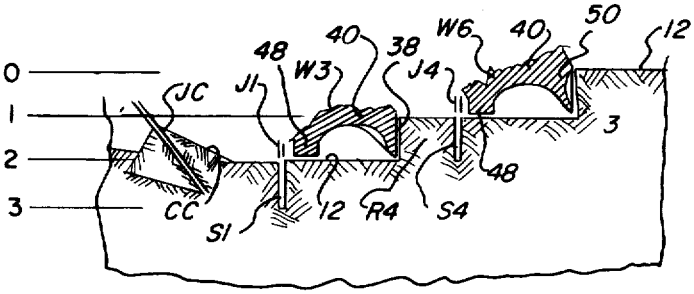
Fig_12-J
CONE III PASSES REFERENCE
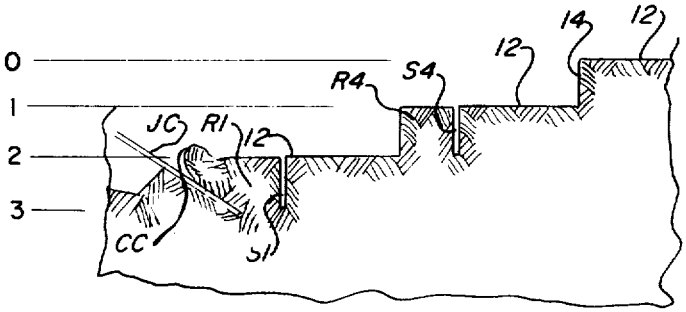
Fig_12-K
CONE II PASSES OPPOSITE REFERENCE

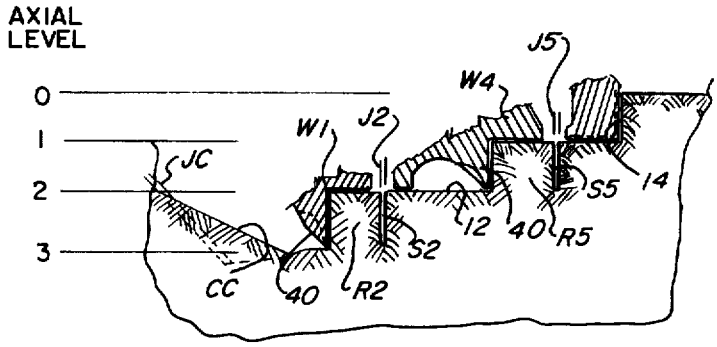
Fig_12-L
CONE I PASSES REFERENCE
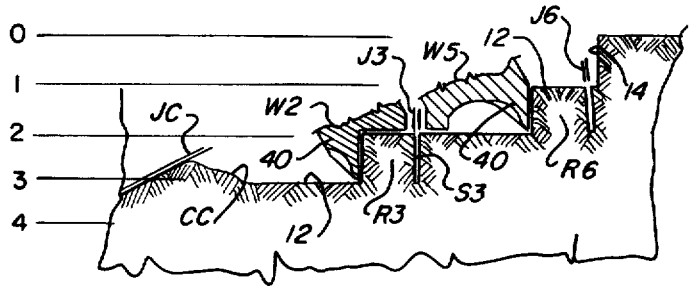
Fig_12-M
CONE II PASSES REFERENCE
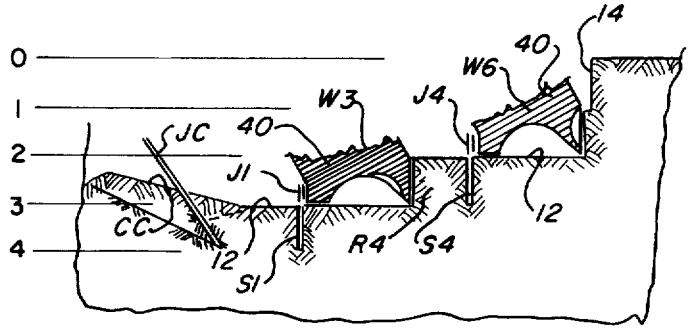
Fig_12-N
CONE III PASSES REFERENCE
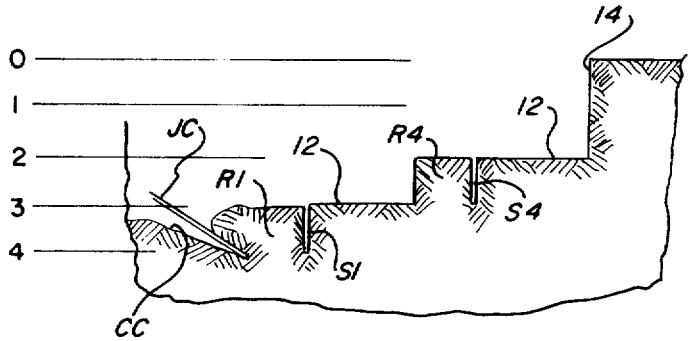
Fig_12-O
CONE II PASSES OPPOSITE REFERENCE

ROTARY DRILL BIT AND METHOD OF FORMING BORE HOLE

BACKGROUND OF THE INVENTION

1. Field of the Invention

This invention relates to the boring of holes into earth material, such as which is typically involved in petroleum and natural gas exploration and mining, for example. More particularly, one aspect of the present invention relates to an earth boring rotary drill bit for cutting an axially advancing bore hole in the earth material. Even more specifically, the present invention relates to a rotary drill bit employing means for emitting a continuous jet of fluid or water to cut material from the bore hole drill face and also employing rotating rock breaking wheels for cooperatively removing the drill face material.

2. Brief Description of Prior Art

One prior art configuration of a rotary drill bit involves a plurality of conically-shaped rock cutting and breaking wheels positioned on a drill bit body and generally arranged as three equally spaced, conically-shaped configurations or cones. Cutting elements or teeth protrude from the wheels and contact the drill face material. The conically shaped wheels traverse circular paths at the drill face of the bore hole as the drill bit is rotated. When axial force is applied to the drill bit through the attached drill string, the teeth cut, break and spall the material of the drill face to axially advance the bore hole. Wash jets of the drill bit deliver a flow of fluid to the drill face for washing the particles of broken material away from the drill face to transport or conduct the broken material out of the bore hole to the surface of the earth, thereby establishing a circulation of wash fluid which removes material from the bore hole. Variations of this conventional drill bit configuration are used for a number of different earth boring applications as is well known in the art.

To achieve the best effectiveness, substantial axial force is required to engage the drill bit with the drill face and to spall the material therefrom. The axial force is transferred through the breaker wheels and applied, for the most part, as a compression force for fracturing and breaking particles from the drill face material. Since rock or earth material requires a relatively large force to fracture in compression, as compared to a substantially lower force which will fracture the earth or rock material in tension, the drill bit and its elements are required to withstand relatively large axial force during use. As a consequence, prior rotary drill bits have experienced relatively short lifetimes in use since the teeth or cutting elements of the breaker wheels are rapidly worn and get dull, or the bearings which allow rotation of the breaker wheels fail after a relatively short period of use. Upon drill bit failure, the lengths of attached pipe comprising the drill string must be removed from the bore hole one length at a time to replace the drill bit. Replacing the drill bit is a time consuming process which increases the cost of cutting the bore hole and lengthens the time required to cut the bore hole to its desired depth. It is not uncommon that cutting relatively deep bore holes through hard rock will require replacement of the rotary drill bit at least a dozen times before the bore hole is completely cut to its desired depth.

The substantial axial force supplied through the drill string can have the effect of creating downhole deviation as the bore hole is cut. Downhole deviation results when the bore hole which is actually cut, angles or deviates from the desired axis along which the bore hole is intended to be cut. Downhole deviation, once started, is difficult to correct. Downhole deviation may result in the bore hole missing or avoiding the geological formation or area which the objective of the drilling operation is to intersect.

The substantial axial force supplied through the drill string can also have the effect of creating slothing. Slothing occurs when the axial force fractures the rock formation surrounding the bore hole. Fractures in the surrounding earth material prevent the wash fluid from effectively conducting the material removed from the drill face up the bore hole and to the surface of the earth, resulting in loss of circulation. With loss of circulation the material removed from the drill face cannot be effectively transported out of the bore hole, which results in inhibiting or terminating the ability to further cut the bore hole.

Rotary drill bits with rotating breaker wheels are constructed differently depending upon the type and hardness of the earth material which is drilled. In drilling a typical bore hole, it is not uncommon that many different rock formations and earth materials will be encountered. Drilling through different earth materials may also require the changing of the drill bit which, of course, also increases the cost of and time for drilling the bore hole. Other disadvantages of prior rotary drill bits employing breaker wheels are also known and of significant consequence in utilizing drill bits of this type in cutting bore holes.

It is known that a concentrated jet of relatively high pressure or energy water or fluid will effectively cut rock, earth materials and the like. To a limited extent, high pressure fluid jets have been used in conjunction with rotary drill bits to cut bore holes. Publications relating to the use of fluid or water cutting jets with rotary drill bits include the following: *Novel Drilling Techniques* by William C. Maurer, Pergamon Press, 1968, Library of Congress Card No. 68-17738; "High Pressure Drilling", Journal of Petroleum Technology, July, 1973, pp. 851-859; "Cutting Rock With Water Jets", International Journal of Rock Mechanics, Mineral Science and Geomechanics Abstract, Vol. 11, pp. 343-358, 1974; "A Rotating Water Jet Device and Data on its Use for Slotting Berea Sandstone", International Journal of Rock Mechanics, Mineral Science and Geomechanics Abstract, Vol. 11, pp. 359-366, 1974; "Recent Advances in Rotary Drill Bits", Oil World, Mar. 9, 1977, pp. 52-56; and U.S. Pat. No. 3,838,742.

It is generally proposed by the present invention that the use of high energy water or fluid jets to cut bore holes will achieve an increase in cutting rate and a decrease in the time required for boring the hole. In addition, however, many disadvantages of the prior art rotary drill bit employing rotating breaker wheels may be avoided or overcome, and many advantages previously unobtainable with prior rotary drill bits can be obtained, as results of the present invention.

SUMMARY OF THE INVENTION

Objectives of the present invention are to provide a new and improved rotary drill bit and method of cutting an axially extending bore hole, which obtain the desirable characteristics of: increasing the speed by which the bore hole is cut or bored, decreasing the cost of drilling a typical bore hole, obtaining wide adaptability and regulational characteristics for achieving effective drilling in a variety of different types and hardnesses of earth materials, avoiding the forces and stresses prevalent in conventional drilling techniques, eliminating or reducing the tendancy toward downhole deviation and slothing, channeling or confining the bore hole to desired axial path, applying tensional force creating a bending movement to break rock rather than compression force, increasing the usable lifetime of a rotary drill bit, and removing a center core or opening of the drill face material prior to removing the remainder of the drill face material to aid in channeling the bore hole along its desired axis.

Other objectives of the present invention are to provide a new and improved rotary drill bit of the type having rotating breaker wheels and means for emitting a continuous relatively high pressure jet of fluid or water to cut the drill face material, which obtains the further desirable characteristics of: protecting the fluid cutting jet emitting means from debris present at the bore hole drill face, minimizing the standoff distance between the cutting jet emitting means and the drill face material to thereby increase the effectiveness of the jets in cutting and removing the material, effectively cutting and opening a center core or opening in the drill face, and removing volumes of drill face material with the emitted jets in direct relation to the distance of the path traversed by each of the cutting jet emitting means as the drill bit rotates.

The rotary drill bit for cutting an axially advancing bore hole through earth material and a method of cutting the bore hole through earth material, according to the present invention, generally involve cutting a center core or opening in the earth material concentric about the axis of the bore hole and removing the material annularly surrounding the center core after the center core has been cut. The center core is opened and the material annularly surrounding the center core is removed in a continuous helically advancing manner during rotation of the drill bit. The material annularly surrounding the center core is removed by cutting a plurality of circular slots concentric with the axis of the bore hole and breaking the rings defined by radially adjacent slots. Slot cutting and ring breaking progresses sequentially from a radially inner position adjacent the center core to a radially outer position adjacent the outer periphery of the bore hole at a given axial position or level. The material annularly surrounding the center core is essentially removed beginning after the center core has been cut and opened. The material annularly surrounding the center core is simultaneously removed in two segments at two different axial levels. A radially inward segment is removed during one revolution of the drill bit and the radially outward segment is removed during the next subsequent revolution of the drill bit, at a given axial level. The center core, the radially inward segment and the radially outward segment are continuously advanced in a downward spiralling helical manner, thereby simultaneously resulting in cutting the drill face and removing material from the drill face on a plurality of separated levels. The center core is opened first at a given axial level, the radially inward annular segment is next cut and removed essentially on the axial level defined by the center core, and the radially outward annular segment is essentially cut and removed on a lesser advanced axial level. The axial distance separating the inward and outward annular segments at which the drill face material is cut and removed is approximately the distance of advancement of the rotary drill bit as a whole with each revolution of the drill bit. The annular rings of material defined by the concentric slots are removed by applying a radially inward directed force which breaks the rings with tensional force by applying a bending movement to the rings.

The center core and the plurality of concentric slots are preferably opened and cut, respectively, by means for emitting continuous high pressure fluid jets to cut the drill face material. The annular rings defined by the concentric slots are preferably removed by rotating breaker wheels which act on and break each annular ring after the ring is defined by the slots. The center core is opened and cut by a fluid cutting jet which is angled with respect to the axis of the bore hole and the axis of the rotating drill bit to cut a generally helically advancing center core opening as the drill bit rotates. Preferably the fluid jet which cuts the center core opening intersects the axis of the bore hole at an acute angle and crosses through the axis. The rotating breaker wheels are carried by axle shafts of the drill bit, and the means for emitting fluid jets may be positioned on the axle shafts radially adjacent the wheel members.

A preferred embodiment of the invention itself, including its organization, its use and method of operation, its assembly and further objects and advantages, will best be understood by reference to the following brief description of the drawings and detailed description of the preferred embodiment.

BRIEF DESCRIPTION OF THE DRAWINGS

FIGS. 12-A through 12-O are schematic sectional views taken axially through the bore hole illustrating the complete right-hand portion and a fractional left-hand portion of the center core opening and the drill face material annularly surrounding the center core opening, in the section reference plane extending generally from the center core opening through the bore hole axis to the outer right-hand periphery of the bore hole. FIGS. 12-A through 12-O depict the sequence of drill face material removal and bore hole cutting as the result of the three cone-shaped configurations rotating through the right-hand section reference from a ground or reference axial level through a fourth axially advanced level, as a result of use of the drill bit and in accordance with the concepts of the present invention.

DESCRIPTION OF THE PREFERRED EMBODIMENT

Figure 1:
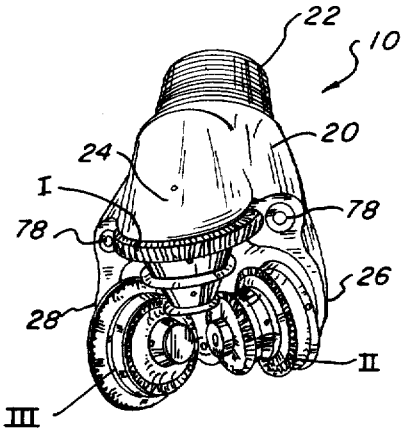
FIG. 1 is a perspective view of a rotary drill bit embodying the present invention and comprising fluid cutting jet emitting means and rotatable rock breaking wheels arranged generally in three cone-shaped configurations.
Figure 3:
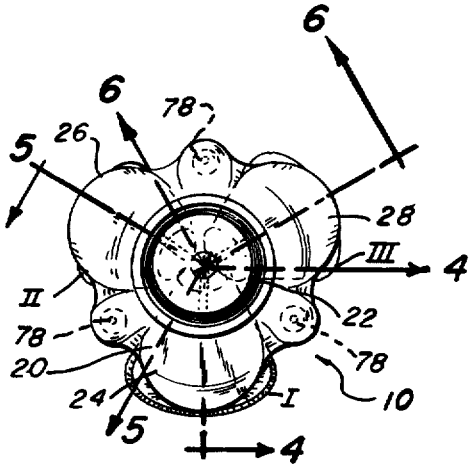
FIG. 3 is a planar end view of FIG. 1 viewed from the axial end of the rotary drill bit opposite that end illustrated in FIG. 2 and to which a drill string is connected.
Figure 2:
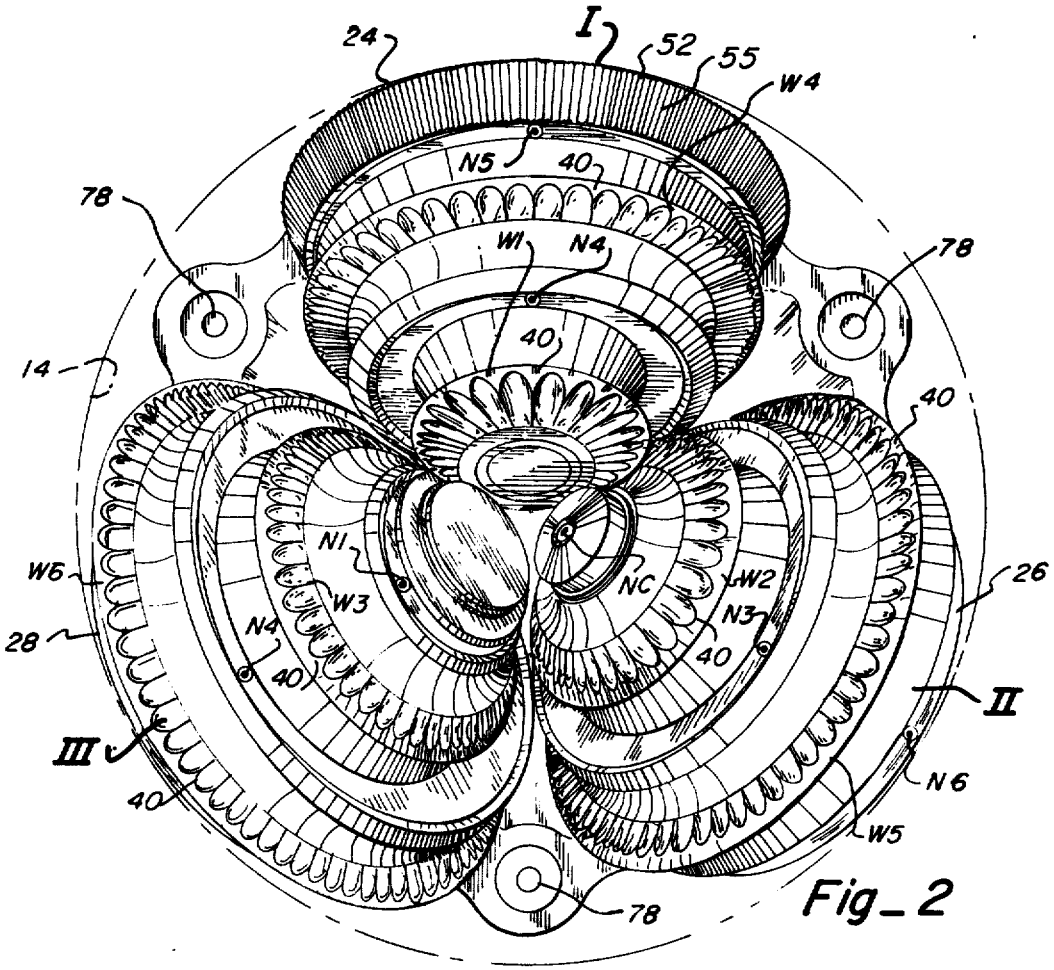
FIG. 2 is an enlarged planar end view of FIG. 1 viewed from the axial end of the rotary drill bit which contacts and removes earth material from the drill face of the bore hole.

A rotary drill bit 10 for cutting an axially advancing bore hole through earth material by rotation of the drill bit 10 at a drill face of the bore hole, according to a preferred embodiment of the present invention, is illustrated in FIGS. 1, 2 and 3. The rotary drill bit 10 is of a tricone configuration, having first, second and third generally conically shaped configurations of elements formed as a part thereof. The first conically shaped arrangement, hereinafter designated as a first cone and referenced I and shown in more detail in FIG. 4, comprises two separate rotatable breaker wheel member W1 and W4, and nozzle means N2 and N5 for emitting continuous high pressure cutting jets J2 and J5, respectively, of fluid such as water. The second conically shaped arrangement, hereinafter designated as a second cone and referenced II and shown in more detail in FIG. 5, comprises two separate rotatable breaker wheel members W2 and W5 and nozzle means NC, N3 and N6. Nozzle means N3 and N6 emit continuous high pressure cutting jets of fluid J3 and J6 respectively, and nozzle means NC emits a continuous high pressure center fluid cutting jet JC. The third conically shaped arrangement, hereinafter designated as a third cone and referenced III and shown in more detail in FIG. 6, comprises two separate rotatable breaker wheels W3 and W6 and nozzle means N1 and N4 for emitting continuous high pressure cutting jets of fluid J1 and J4 respectively. Typically, the fluid cutting jet emitting means and the breaker wheels operate simultaneously during use of the drill bit 10.

Each of the nozzle means is positioned in a cone at a different radial distance from the axis of the drill bit 10 and, consequently, at a different radial distance from the axis of the cylindrical bore hole formed by the drill bit. From a radial innermost position to a radially outermost position, the nozzle means are positioned in this order: NC, N1, N2, N3, N4, N5 and N6. As is shown in FIGS. 8 through 12-O, this nozzle arrangement causes fluid jets J1 to J6 to cut a plurality of concentric circular slots S1 to S6 respectively in the drill face material 12 when the drill bit 10 is rotated in contact with the drill face. The center fluid jet JC, emitted from the center nozzle means NC, intersects the axis of the drill bit at an acute angle and passes through the axis of the bore hole to cut a center opening about the axis of the bore hole, hereinafter referred to as a center core opening CC, when the drill bit 10 is rotated in contact with the drill face. Annular rings of material R1 to R6 are defined by the center core opening CC and the slots S1 to S6. The radially intermost ring R1 is defined by the drill face material intermediate the center core opening CC and slot S1; ring R2 is defined by slots S1 and S2; and in a similar manner, the rings R3 through R6, positioned at successively increasing outward radial positions, are defined by slots S2 through S6 as is shown in FIGS. 8 through 12-O.

Figure 4:
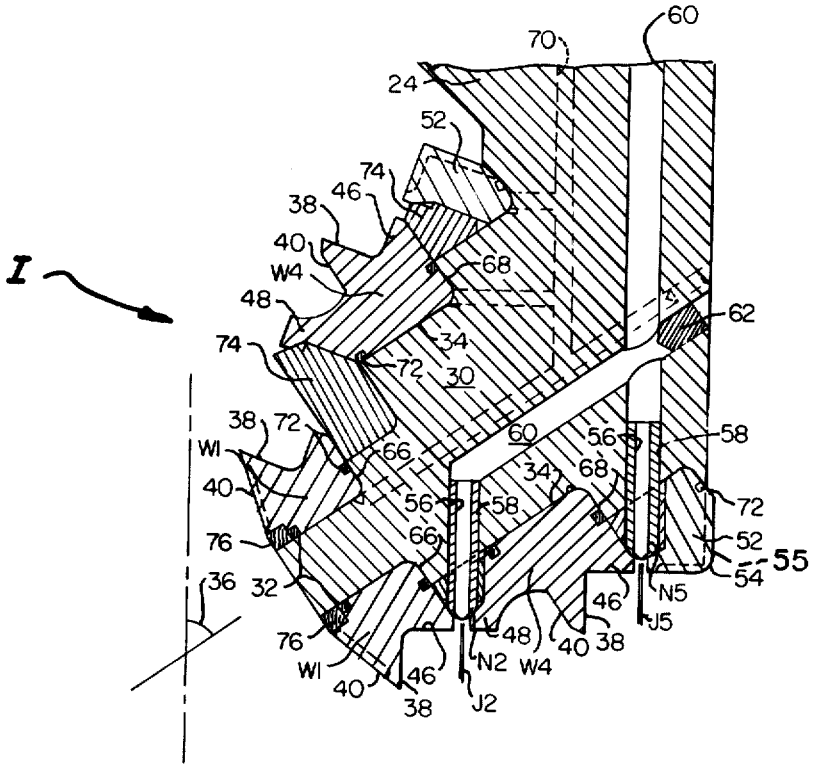
FIG. 4 is an enlarged section view taken substantially in the plane of line 4—4 of FIG. 3 illustrating a first of the cone-shaped configurations in greater detail.
Figure 5:
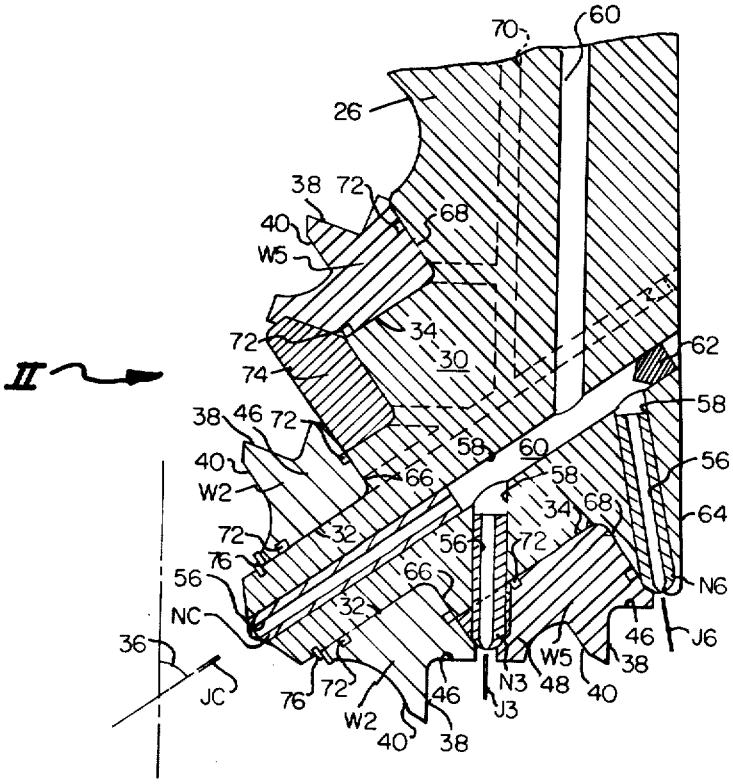
FIG. 5 is an enlarged section view taken substantially in the plane of line 5—5 of FIG. 3 illustrating a second of the cone-shaped configurations in greater detail.
Figure 6:
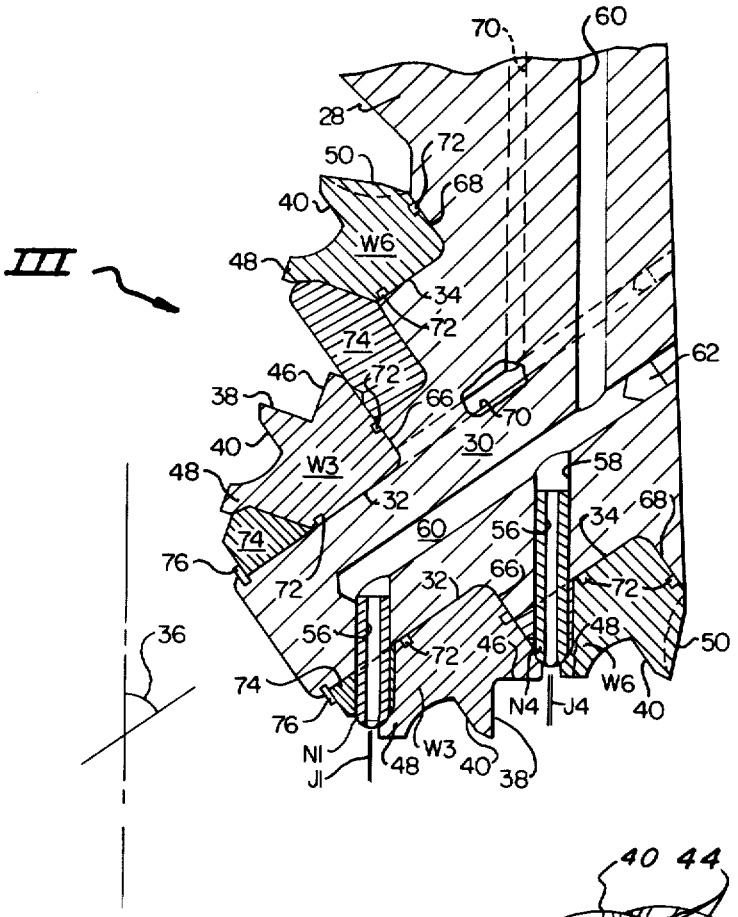
FIG. 6 is an enlarged section view taken substantially in the plane of line 6—6 of FIG. 3 illustrating a third of the cone-shaped configurations in greater detail.

The cutting effect from the fluid jets emitted from the nozzle means of cones I, II and III occurs on a plurality of axially displaced levels or positions as is illustrated schematically in FIGS. 9 through 12-O. As is shown in FIGS. 4, 5 and 6 each of the radially inner positioned nozzle means N1, N2 and N3 occupies a more axially advanced position on its cone than the radially outward positioned nozzle means N4, N5 and N6. The center nozzle means NC of FIG. 5 emits the angled center jet JC which cuts the drill face material at the most axially advanced position or level of any of the cuts in the drill face. Jets J1, J2 and J3 cut slots S1, S2 and S3 in a radially inward segment of drill face material annularly surrounding and adjacent to the center core opening CC. The radially inward segment extends radially from the center core opening CC outward to the slot S3. Jets J4, J5 and J6 respectively cut slots S4, S5 and S6 in a radially outward segment of material annularly surrounding and adjacent to the radially inward segment. The radially outward segment is defined by the material between slot S3 and the outer periphery of the bore hole 14. Slots S4, S5 and S6 are cut in the drill face material of the outward annular segment in a least advanced axial position. Thus, the center core opening is cut and opened by the center jet, slots S1 through S3 are cut generally at the axial position of the center core, and slots S4 through S6 are cut at a lesser axially advanced position, as is apparent from FIGS. 9 through 12-O.

Each of the breaker wheels W1 to W6 is positioned on a cone at a different radial distance from the axis of the drill bit 10 and, consequently, at a different radial distance from the axis of the cylindrical bore hole 14 formed by the drill bit. From a radial innermost position to a radial outermost position, the breaker wheels are positioned in this order: W1, W2, W3, W4, W5 and W6. Shown in FIGS. 12-A through 12-O breaker wheels W1 through W6 respectively traverse radially spaced circular paths at rings R1 through R6 to break the drill face material of rings R1 through R6, after the fluid jets have defined each particular ring of material. The breaker wheels apply a radially inward directed force to the outer periphery of each ring, which causes a tensional force and bending movement on the ring, thereby breaking the ring with considerably less force than is typically required to break a comparable volume of the same rock in compression force.

As is shown in FIGS. 4, 5 and 6, the breaker wheels W1, W2 and W3 of cones I, II and III are positioned to contact the drill face at a more axially advanced position than the radially outward positioned breaker wheels W4, W5 and W6, respectively, on each cone. The center jet JC cuts material to open and define the center core opening CC prior to the breaking of rings R1 to R6 by the breaker wheels. Breaker wheels W1 to W3 respectively break rings R1 to R3 of the inward segment of material annularly surrounding the center core opening CC. Breaker wheels W1 to W3 are positioned to encounter the rings of the inward segment of material annularly surrounding the center core opening on the axial level or position of the radially inward segment. Breaker wheels W4 to W6 respectively break rings of material R4 to R6 of the outward segment of material annularly surrounding the inward segment. Breaker wheels W4 to W6 are positioned to encounter rings R4 to R6 at the axial position or level of the outward annular segment of material, i.e. at the lesser axially advanced position or level.

The rotary drill bit 10 shown in FIGS. 1 and 3 includes a bit body 20 and means for rotating the drill bit 10 such as a threaded connection 22 for threadably connecting a drill string (not shown), which is formed by a number of threadably interconnected drill pipes. The bit body 20 includes three equally radially spaced, projection members or pieces 24, 26 and 28 which respectively support and operatively position the cones I, II and III.

As is shown in FIGS. 4, 5 and 6, each of the projection members 24, 26 and 28 includes an axle shaft 30 integrally formed to and extending from one of the projection members. Journals 32 and 34 formed on the axle shafts 30 receive, respectively, one radially inward positioned breaker wheel (W1, W2 or W3) and one radially outward positioned breaker wheel (W4, W5 or W6). When received on the journals 32 and 34, each of the breaking wheels W1 to W6 has an axis of rotation which intersects the axis of the drill bit 10 (and the axis of the bore hole 14) at an acute angle referenced at 36 which is fifty-five degrees.

Figure 7:
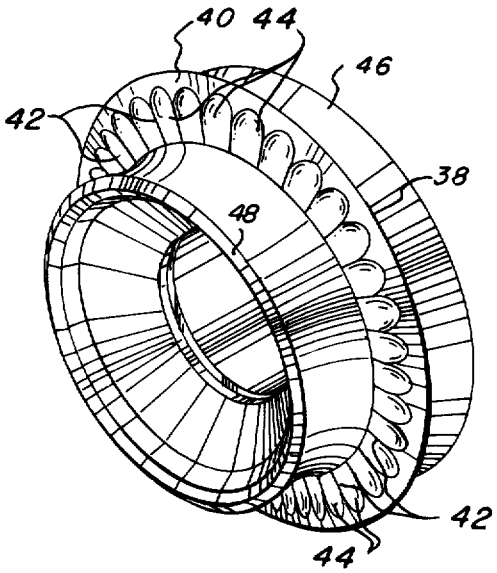
FIG. 7 is a perspective view of the major portions of one exemplary rotatable breaker wheel similar in essential respects to those breaker wheels illustrated in the three cone-shaped configurations.

Components of the breaker wheels are better understood by reference to FIG. 7 in conjunction with FIGS. 4, 5 and 6. The breaker wheels W1 through W5 each include an outer radial surface 38 which extends axially at the lowermost position of the breaker wheels contacting the drill face when the breaker wheels W1 to W5 are positioned on the journals 32 and 34 of the axle shafts 30. The surfaces 38 breaker wheels W1 and W5 are angled whereby the surface 38 axially extends within one of the concentric slots S1 through S5. The outer radial surface 50 of breaker wheel W6 is different from the surface 38 of wheels W1 to W5, since surface 50 cuts the outer periphery of the base during rotation as will be explained more fully. Breaker wheels W1 through W6 each include a surface 40 which angles radially inward when the breaker wheels W1 to W6 are positioned on the journals 32 and 34 of the axle shafts 30. The surface 40 includes a plurality of ridges 42 and valleys or indentions 44 which separate the ridges 42. The ridges 42 angle more steeply from the outer periphery of the breaker wheels than do the valleys 44, and thereby form a configuration somewhat similar to teeth on the breaker wheels W1 to W6. The radially inward angled ridges 42 and valleys 44 apply radially inward directed force to the rings R1 to R6, to fracture those rings by a bending movement. The configuration of ridges and valleys, somewhat like teeth, aids in breaking the rings into pieces. When the rings are fractured by the bending moment, particles of the ring material are broken toward the center of the bore hole by the radially inward directed force from the radially inward angled elements of surface 40. Opening or cutting the center core opening prior to breaking the ring R1 allows the material of ring R1 to be broken with a bending movement and to be broken toward the center of the bore hole.

Shown in FIGS. 4 through 7, breaker wheels W1 to W5 include extensions 46 which extend radially outward from the outer surfaces 38 toward nozzle means N2 to N6 respectively. Breaker wheels W3 to W6 include extensions 48 which extend radially inward from the inner surface 40 toward nozzle means N1 to N4 respectively. The extensions 46 and 48 from the breaker wheels terminate at a position below the nozzle means. The space separating the extensions 46 and 48 below the nozzle means is larger than the width of the fluid jet emitted by the nozzle means. In this manner the extensions 46 and 48 from the breaker wheels protect the nozzle means from debris and other particulate matter at the bore hole drill face which might interfere with proper operation of the nozzle means and the fluid jets emitted therefrom.

In cone III shown in FIG. 6, the radially outermost surface 50 of breaker wheel W6 includes ridges and indentions formed therein for the purpose of forming the outer periphery of the bore hole 14. The ridges and indentions of surface 50 function similarly to the ridges 42 and indentions 44 of the inner surface 40 of the breaker wheel illustrated in FIG. 6. The ridges and indentions of surface 50 of breaker wheel W6 remove the spur of material left by the slightly radially outward angled jet J6 emitted from nozzle means N6 while cutting slot S6. See FIGS. 9 and 10, for example. In this manner, the outside periphery of the bore hole is made relatively even and smooth.

Cone I illustrated in FIG. 4 employs a shoe wheel 52 not present in Cones II and III. The shoe wheel 52 rotates about its axle shaft 30 with its outer radial surface 54 against the outer periphery of the bore hole 14, for the purposes of further smoothing the outer periphery of the bore hole and of aiding positioning of the drill bit about the axis of the bore hole. A plurality of grooves 55 are formed on the shoe wheel 52 for smoothing the bore hole periphery.

The diameters of breaker wheels W1 to W6 and the diameter of shoe wheel 52 are calculated to traverse desired circular paths without deviating substantially therefrom. The diameter of each wheel member depends on the angle of its axis of rotation with respect to the bore hole axis and the radius of the intended circular path to be traversed.

The orifice of each nozzle means is formed by an opening formed in a material highly resistant to erosion, and the orifice material (not shown) is securely received within a steel sleeve 56 which is shown in FIGS. 4, 5 and 6. Each steel sleeve 56 is preferably resistance welded into a channel 58 formed in each axle shaft 30. Nozzle means N1 to N6 are positioned in each axle shaft 30 radially adjacent at least one breaker wheel, and nozzle means N2, N3 and N4 are positioned intermediate two breaker wheels. A supply of high pressure and energy fluid such as water is supplied to the nozzle means through channels 60 formed in the projection members 24, 26 and 28 and axle shafts 30 such as by drilling. The supply of high energy water is conducted through the interior of the drill string from the ground surface through suitable conductors and intensifiers to provide a pressure of emission which exceeds the threshold pressure of the rock or earth material which is being drilled. Suitable plugging means 62 are inserted to terminate the outer ends channels 60.

In cone II illustrated in FIG. 5, the center nozzle means NC extends coaxially or substantially parallel with the axes of journals 32 and 34. The emitted jet JC, which is adapted to cut the center core opening CC of the bore hole 14, intersects the axis of the drill bit at essentially the same acute angle 36 as the axes of rotation of the breaker wheels. The center jet JC is emitted from the nozzle means NC of cone II at a position spaced from the axis of the drill bit, but the major effect in cutting and removing the drill face material to open the center core occurs radially opposite of cone II. The center jet JC cuts the center core opening CC about the axis of the bore hole without aid of mechanical assistance. Because of cutting center core opening first, the material annularly surrounding the center core opening can subsequently be broken toward the opening CC.

Nozzle means N6 is positioned in Cone II closely spaced from the outer edge 64 of the projection member 26. Nozzle means N6 emits the jet J6 angled slightly radially outward with respect to the axis of the bore hole. Nozzle means N6 is positioned in this manner since the nozzle means N6 cannot be positioned to emit the jet J6 exactly at the outer radial periphery of the bore hole. However, arranged in this manner, jet J6 cuts the outer radial slot S6 closely adjacent the outer periphery of the bore hole.

Each of the cones I, II and III is axially positioned by their respective projection members 24, 26 and 28 at different axial levels or positions from one another on the drill bit 10. Cone I occupies the most axially advanced position of the drill bit 10, with breaker wheels W1 and W4 contacting the drill face material at the most axially advanced position of any of the breaker wheels at the inward annular segment and outward annular segment, respectively. Cone II is less axially advanced than cone I by approximately one-third of the distance of expected advancement of the drill bit 10 as a whole during one single revolution of the drill bit, and breaker wheels W2 and W5 are positioned with respect to breaker wheels W1 and W4 on an axial level less advanced by approximately the distance of one-third of the expected advancement of the drill bit with one revolution. In a similar manner, cone III and breaker wheels W3 and W6 are positioned with respect to cone II and breaker wheels W2 and W5 at an axial level less advanced by approximately the distance of one-third of the expected advancement of the drill bit during one revolution.

By axially separating the cones by one-third of the expected distance of advancement of the drill bit with one revolution as has been described, the nozzle means and breaker wheels operatively remove the drill face material in a smooth helically downwardly spiraling manner. With each one-third of a drill bit revolution, each cone rotates downward to approximately the same axial level of the cone which preceeded it at that level. With this arrangement, at any given axial position, the passage of the cones over the drill face by rotation of the drill bit removes the drill face material annularly surrounding the center core in a sequential manner at that axial level from a radially inward position adjacent the center core to a radially outward position adjacent the outer periphery of the bore hole, as will be more apparent from the description of operation taken in conjunction with FIGS. 12-A through 12-O.

A more specific understanding of certain details of cones I, II and III may be obtained by reference to FIGS. 4, 5 and 6. Shoulder portions 66 and 68 are formed on the axle shafts 30 extending perpendicularly from the journals 32 and 34 respectively. The shoulder portions 66 and 68 prevent the breaker wheels from moving radially outward on the journals from their intended positions. Journal bearings (not shown) are received intermediate the journals and the openings in the breaker wheels for receiving the journals. Thrust bearings (not shown) are positioned on the shoulder portions 66 and 68 perpencidular to the journals to allow the breaker wheels to rotate on the cones against the shoulders. In a similar manner, shoulder portions and journal and thrust bearings are provided on Cone I for the shoe wheel 52. Lubricant is applied to the journal and thrust bearings through channels 70. The channels 70 lead from well known lubricant reservoirs (not shown) formed within the drill bit body 20, which are packed with lubricant prior to initiation of the drilling process. Seals 72 contain the lubricant around the journal and thrust bearings. Appropriately configured spacers 74 are rigidly positioned on the axle shafts 30 intermediate the breaker wheels and at other desired positions for the purpose of preventing the entry and interference of debris and pieces of the earth material between the various elements of each of the cones I, II and III. Means such as keepers 76 are positioned at the inner radial end of each axle shaft 30 for maintaining the breaker wheels and spacers in assembled relation on the cones I, II and III.

As is shown in FIGS. 1 and 3, conventional wash nozzles 78 for emitting jets of washing fluid are positioned intermediate the projection members 24, 26 and 28. The flow of washing fluid emitted from nozzles 78 circulates about the drill face for transfering and conducting the particles of the earth material removed by the drill bit to the surface of the earth. The fluid supplied to the wash nozzles 78 is conducted through the interior of the drill string, as is known in the art. The wash jets emitted from the nozzles 78 are not intended to and do not cut or erode the material of the drill face; the wash jets simply conduct and carry the particles removed away from the drill face and out of the bore hole.

Assembly of each of the cones I, II and III with their respective elements will be discussed separately. Cone I shown in FIG. 4 is assembled by first placing the shoe wheel 52 over the axle shaft 30. Nozzle means N5 is resistance welded into its channel 58, and the radially outer spacer 74 and breaker wheel W4 are then positioned on the axle shaft. Nozzle means N2 is secured into its channel 58, and thereafter radially inner spacer 74 and breaker wheel W1 are assembled to the shaft 30. This group of elements is held in position by the keeper means 76 attached at the radially inner end of the axle shaft. During assembly of Cones I, II and III, the journal and thrust bearings and seals are assembled in the appropriate relationship with the described elements as would be apparent to one skilled in the art.

Assembly of cone II shown in FIG. 5 begins with securing nozzle means N6 in its channel 58. Breaker wheel W5 is positioned over the axle shaft journal 34 and nozzle means N3 is secured into its channel 58. The spacer 74 and breaker wheel W2 are then positioned on the axle shaft. These elements are retained in position by the keeper means 76. The center nozzle means NC is secured into its channel 58 at any time during the assembly of cone II.

Cone III shown in FIG. 5 is assembled by first positioning breaker wheel W6 on the journal 34 of the axle shaft 30. Nozzle means N4 is secured into its channel 58. The radially outer spacer 74 and breaker wheel W3 are positioned on the axle shaft. Nozzle means N1 is secured into its channel 58, and the radially inner spacer 74 is positioned on the axle shaft 30. The keeper means 76 retains the elements of cone III in this assembled relationship.

Operation of the drill bit 10 and the method of the present invention in cutting or forming an axially extending bore hole 14 through material by rotation of the drill bit in contact with the drill face 12 of the bore hole is illustrated in FIGS. 12-A through 12-O. Beginning at the ground surface level as is shown in FIG. 12-A, and progressing through four revolutions of the drill bit, the drill face material is removed to axially form the bore hole. In FIGS. 12-A through 12-O, a section through a major portion of the center core of the bore hole and through the right hand half of the remainder of the bore hole has been selected for illustration. The operations at the left hand portion of the bore hole, which are not shown, occur essentially in the same manner as those illustrated on the right hand side, with the exception that the left hand operations occur one-half revolution of the drill bit earlier and later relative to those occurring on the right hand section. Each axial level or position to which the drill bit axially advances by removing the drill face material has been designated by a reference numeral, beginning with 0 to indicate the ground or initial reference level and progressing to more advanced or deeper axial levels ending with 4 at the deepest or most advanced axial level illustrated. The drill face material is removed and the bore hole is axially advanced by one additional axial level or position with each rotation of the drill bit as will become more apparent.

The operations conducted on the bore hole drill face by the elements of the drill bit 10, and the condition of the drill face 12 of the bore hole 14 have been illustrated in relationship to the rotational position of cones I, II and III at various axially advanced positions or levels of the bore hole. FIGS. 12-A, 12-B and 12-C illustrate the significant effects at the drill face 12 of the bore hole during the major portion of the first revolution of the drill bit. FIGS. 12-D, 12-E, 12-F and 12-G illustrate the effects on the drill face during the second revolution of the drill bit. FIGS. 12-H, 12-I, 12-J and 12-K illustrate the effects during the third revolution of the drill bit, and FIGS. 12-L, 12-M, 12-N and 12-O illustrate the effects during the fourth revolution which are essentially the same as the effects occurring during the third revolution.

The rotational position selected for illustration of the beginning and ending point of each revolution of the drill bit is that position where cone II is essentially radially opposite the right hand section reference, which position is illustrated in FIGS. 12-C, 12-G, 12-K and 12-O. Due to selection of this point for designating separate revolutions of the drill bit, the rotation of cone I past the right hand section reference during the first revolution of the drill bit causes little effect on the initial drilling surface at axial position or level 0, so this position has not been illustrated. However, FIGS. 12-D, 12-H, and 12-L represent the condition of the bore hole drill face as cone I passes the right hand section reference during the respective second, third and fourth revolutions of the drill bit. FIGS. 12-A, 12-E, 12-I and 12-M illustrate the condition of the drill face as cone II rotates past the right hand section reference during the respective first, second, third and fourth revolutions of the drill bit. FIGS. 12-B, 12-F, 12-J and 12-N illustrate the condition of the drill face as cone III rotates past the right hand section reference during the respective first, second, third and fourth revolutions of the drill bit. FIGS. 12-C, 12-G, 12-K and 12-O illustrate the effect of the center jet JC emitted from cone II on the right hand section reference, and also illustrate the condition of the bore hole drill face at the end of each revolution and beginning of the next subsequent revolution of the drill bit. As has been previously described, the major cutting effect of the center jet JC in cutting the center core opening CC is on the drill face material radially opposite the position of cone II. For this reason, FIGS. 12-C, 12-G, 12-K and 12-O illustrate the condition of the right hand section reference of the bore hole when cone II is radially opposite the right hand section reference, that is, this condition occurs between the rotation of cones III and I past the right hand reference.

FIGS. 12-B, 12-F, 12-J and 12-O illustrate the effects at the drill face of the bore hole one-third of a revolution of the drill bit after the condition illustrated in FIGS. 12-A, 12-E, 12-I and 12-M, respectively. FIGS. 12-D, 12-H and 12-L illustrate the condition of the drill face one-third of a revolution of the drill bit after the condition illustrated in FIGS. 12-B, 12-F and 12-J, respectively. Similarly FIGS. 12-E, 12-I and 12-M illustrate the drill face condition one-third of a revolution after the drill face illustrations of FIGS. 12-D, 12-H and 12-L. FIGS. 12-C, 12-G, 12-K and 12-O illustrate the drill face condition one-sixth of a revolution of the drill bit subsequent to the conditions shown in FIGS. 12-B, 12-F, 12-J and 12-N respectively and prior to the conditions shown in FIGS. 12-D, 12-H, 12-L and a condition (not shown) similar to 12-L, respectively.

The center jet JC emitted from nozzle means NC of cone II cuts the helically advancing center core opening CC about the axis of the bore hole 14, without the aid of any mechanical assistance, through erosion of the rock material by the high energy cutting jet JC. The cut defining the center core opening, if it could be isolated by itself, would generally take the form of an axially advancing crudely threaded hole. The radial width of the center core opening depends on many factors, including the width of the jet JC itself, the angle 36 of the emitted jet, the amount of advancement of the drill bit with each revolution and the characteristics of the earth material.

To initiate the drilling operation, the drill bit is rotated above the earth's surface level where it is desired to form the bore hole. The center jet JC emitted from cone II begins cutting the center core opening CC prior to the point that any part of the drill bit physically contacts the surface level O, as is shown in FIG. 12-A. As the center core opening CC is cut in an axially advancing position allowing the drill bit to axially advance, cone III rotates past the right hand section reference and cuts slot S1 in the material annularly surrounding the center core, as is shown in FIG. 12-B. Shown in FIG. 12-C, cone II has rotated to a position radially opposite the right hand section reference and the center jet JC has completed defining the center core CC to the first axial level 1 and also has completed defining annular ring R1. Thus, during the first illustrated revolution of the drill bit, the center core opening CC has been cut to the first axial level 1 prior to significant removal of the material annularly surrounding the center core opening CC.

Shown in FIG. 12-D, breaker wheels W1 of Cone I rotate past the right hand section reference and the surface 38 of breaker wheel W1 extends axially in slot S1 while the force applying surface 40 of breaker wheel W1 applies radially inward force to the annular ring R1 creating a bending movement on ring R1 to break the ring radially toward the center of the bore hole. At the same time, jet J2 of cone I cuts slot S2 and thereby defines ring R2. Shown in FIG. 12-E, cone II next rotates past the right hand section reference with breaker wheel W2 breaking the material of ring R2 toward the center of the bore hole while jet J3 cuts slot S3 to define ring R3. Shown in FIG. 12-F, cone III rotates past the right hand section reference and breaker wheel W3 breaks ring R3 and jet J4 cuts slot S4 to define ring R4. At the same time, nozzle N1 cuts slot S1 to begin forming ring R1 between the first and second axial levels. The center jet JC has continued to advance the center cut and open the center core opening CC to the next axially advanced level, i.e. from the first level 1 to the second level 2. The center core opening CC is shown completed to the second axial level in FIG. 12-G with cone II radially opposite the right hand section reference and center jet JC emitted therefrom completely defining ring R1 at level 2. At the condition shown in FIG. 12-G, the center core opening CC has been cut to the second axial level 2 while the material of rings R1, R2 and R3 (the first annular segment) has been removed between ground level 0 and the first axial level 1.

Shown in FIG. 12-H, cone I rotates past the right hand section reference with breaker wheels W1 and W4 removing rings R1 and R4 respectively. Jets J2 and J5 emitted from cone I cut slots S2 and S5 thereby defining rings R2 and R5. The center jet JC has begun to cut the center core opening CC from the second axial level 2 toward the third axial level 3, while the material from the first annular segment between the first and second radial levels is being removed, and while the material from the second annular segment, defined by rings R4, R5 and R6, is being removed on the axial level between the ground level O and the first axial level 1. Shown in FIG. 12-I, cone II rotates past the right hand section reference with breaker wheels W2 and W5 removing rings R2 and R5 and with jets J3 and J6 cutting slots S3 and S6. Shown in FIG. 12-J, cone III rotates past the right hand section reference with breaker wheels W3 and W6 removing rings R3 and R6. In addition, breaker wheel W6 removes the rock spur left by the slight radially outward angle of slot S6.

FIG. 12-K illustrates the completed formation of the center core opening CC between the second and third axial levels and the definition of the ring R1 between the second and third axial levels by slot S1 and the center core opening CC at the completion of the third revolution. It is also apparent that the center core opening CC has continually been cut between the second and third axial levels during the time that the first segment annularly surrounding the center core opening (the material between the center core and slot S3) has been completely removed between the first and second axial levels, and during the time that the second segment annularly surrounding the first segment (the material between slot S3 and the bore hole periphery) has been removed between the ground and the first axial levels. Thus it can be readily understood that the drill face is removed at a plurality of advanced levels; the center core is opened first by action of the center jet cutting at the most axially advanced position, the material of the first annular segment is subsequently removed at an axial position of the center core opening during one revolution, and the material of the second annular segment is removed at a position less axially advanced than the first annular segment by approximately the distance of advancement of the drill bit during one revolution.

FIGS. 12-L, 12-M, 12-N and 12-O correspond respectively in operation to the previously described FIGS. 12-H, 12-I, 12-J and 12-K. It also is apparent from FIGS. 12-L to 12-O that the bore hole drill face is advanced simultaneously the plurality of axial levels with each revolution of the drill bit. During each revolution, the center core opening is opened at the most axially advanced position. The group of slots S1, S2 and S3 are cut in the first annular segment and the rings R1, R2 and R3 defined thereby are removed sequentially from a radially inward position to the radially outward position of the first annular segment. The group of slots S4, S5 and S6 are cut in the second annular segment at the same respective times that slots S1, S2 and S3 are cut in the first annular segment. The rings R4, R5 and R6 are removed sequentially from a radially inward position to the radially outward position of the second annular segment. The rings R4, R5 and R6 are respectively removed at the same time that rings R1, R2 and R3 are removed from the first annular segment.

It is also apparent that at any given axial level, the material annularly surrounding the center core opening CC is removed sequentially from an inner radial position adjacent the center core opening to a radial outer position adjacent the outer periphery of the bore hole. For example, consider the removal of the material annularly surrounding the center core opening between the first and second axial levels, as is shown beginning with FIG. 12-G and continuing through FIG. 12-N, during two revolutions of the drill bit shown thereby. The rings at this axial level are removed sequentially in this order: ring R1 is removed first (FIG. 12-H), ring R2 is removed second (FIG. 12-J), ring R3 is removed third (FIG. 12-J), ring R4 is removed fourth (FIG. 12-L), ring R5 is removed fifth (FIG. 12-M), and ring R6 and the rock spur are removed sixth and last (FIG. 12-N).

Figure 8:
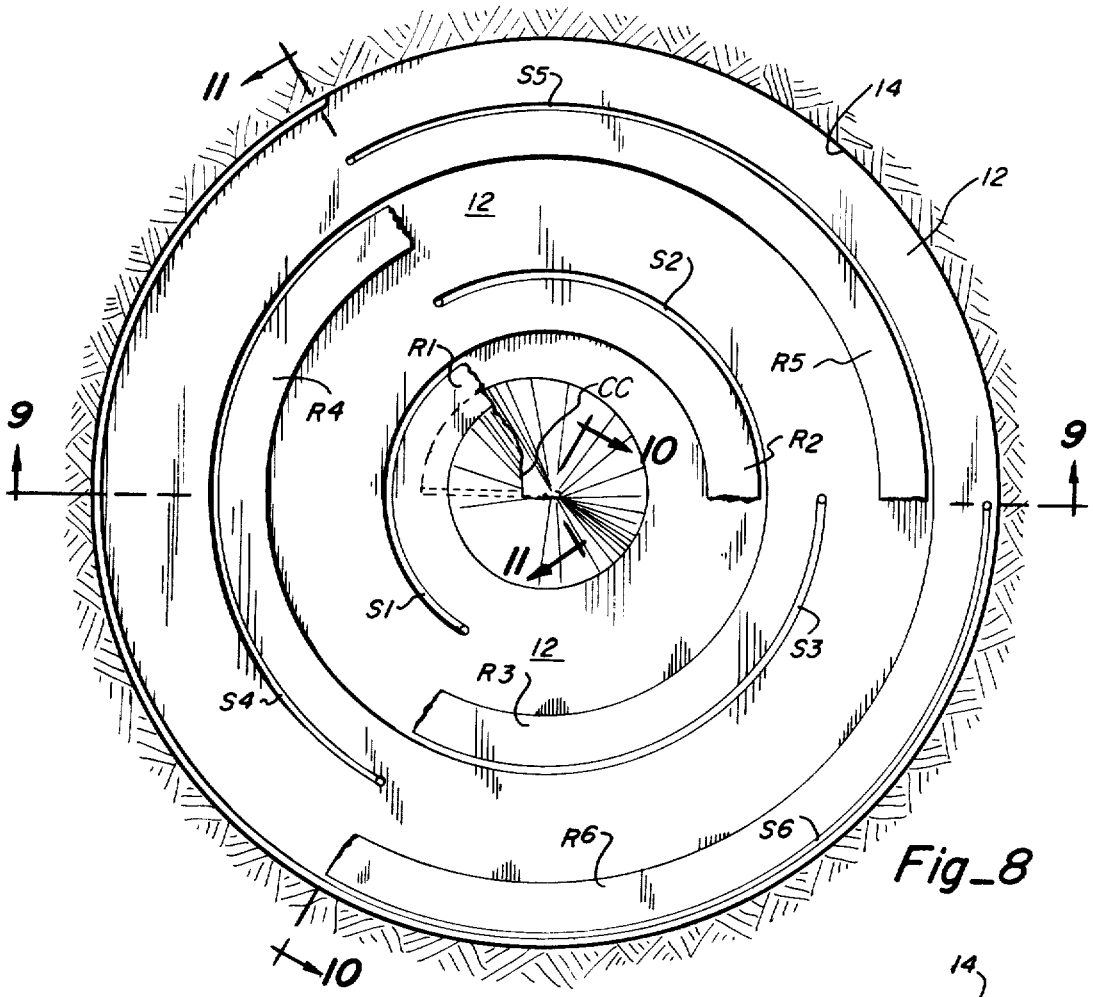
FIG. 8 is a schematic axial view of the bore hole drill face illustrating the cuts and slots formed therein and illustrating the removal of rings defined by the cuts and slots achieved by the three cone-shaped configurations during use and rotation of the drill bit illustrated in FIG. 1.
Figure 9:
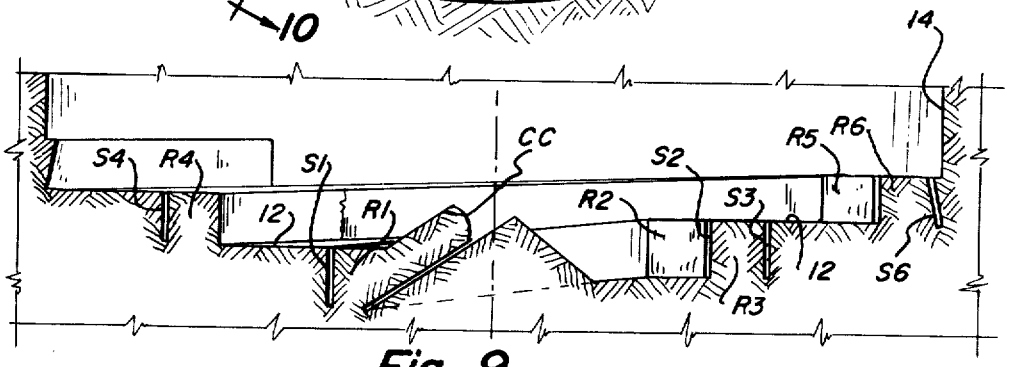
FIG. 9 is a schematic section view taken substantially in the plane of line 9—9 of FIG. 8 generally illustrating the relative axial positions or levels and orientations of the cuts and slots formed, the rings defined in the drill face material, and also illustrating on the right hand portion thereof, the boring effect on the drill face achieved by the second cone-shaped configuration illustrated in FIG. 5 during rotation of the drill bit.
Figure 10:
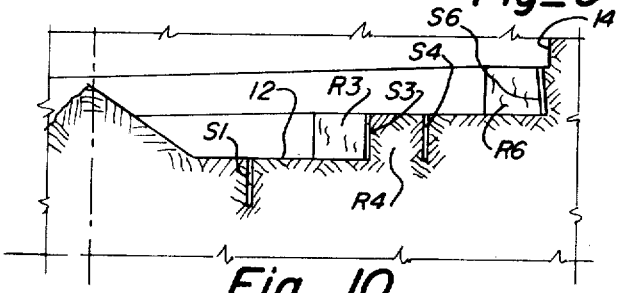
FIG. 10 is a schematic section view taken substantially in the plane of line 10—10 of FIG. 8, generally illustrating the boring effect on the drill face achieved by the third cone-shaped configuration illustrated in FIG. 6 during rotation of the drill bit.
Figure 11:
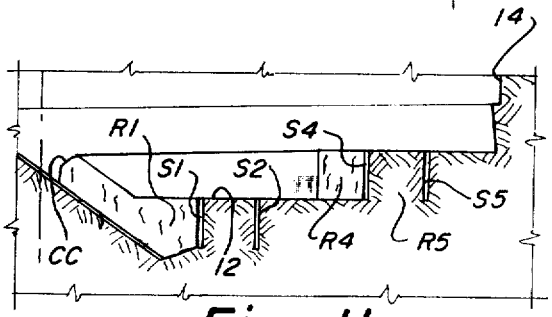
FIG. 11 is a schematic section view taken substantially in the plane of line 11—11 of FIG. 8 generally illustrating the boring effect on the drill face achieved by the first cone-shaped configuration illustrated in FIG. 4 during rotation of the drill bit.

It is apparent from FIG. 8 that the amount of material removed by jet J6 in cutting slot S6 is much greater than the amount of material removed by jet J1 cutting slot S1. It is also apparent that rotation of the drill bit causes nozzle means N6 to move at a much greater speed than nozzle means N1. It is desirable that each slot S1 through S6 be cut essentially to an axial depth of approximately the distance of advancement of the drill bit during one revolution. To obtain uniform slot cut depths, when the radially outward positioned nozzle means traverse the drill face at a higher rate than the radially inward positioned nozzle means and when the radially outward positioned nozzle means are required to remove greater volume of material to define the slots, the fluid jets must be regulated in accordance with their position on the drill bit. The objective is to deliver essentially the same amount of fluid jet energy for a given volume of material removed in defining a slot. To attain this objective, the radially outward postioned jets may be formed increasingly more eliptical, according to their radial position, with the longer dimension of the elipse tangential to the slots cut. Alternatively, the nozzle means positioned progressively more radially outwardly may be made of progressively increasing diameter to emit a larger diameter jet. A further alternative is to supply a multiplicity of individual fluid cutting jets at the radial position where more fluid jet energy is required.

If, during operation of the drill bit, the drill bit encounters extremely hard rock or earth material, the slots and center core opening may not extend axially as far as in softer rock or earth material. Upon encountering hard rock or earth material, the rotational speed of the drill bit can be decreased to allow more time for application of the fluid jet energy to the hard rock or earth material, thereby increasing the depth of the cuts. This result is easily achieved and allows use of the drill bit in a wide variety of different rock formations merely by regulating its rotational speed. However, even if the rotational speed is not regulated, the removal of the drill face material essentially proceeds only as deep as the slot cuts extend. In either case, the expected rate of advancement is generally two to three times more than the rate of advancement obtained by typical prior art rotary drill bits.

By the present invention, it is apparent that the means for emitting fluid cutting jets are greatly beneficial in rapidly advancing the bore hole. The center jet completely removes material to open the center core while jets J1 through J6 cut slots to define annular rings of material. The rings are easily and advantageously removed by breaking the rings in sequence by applying tensional force in distinction to compression force typically employed in prior art drill bits. By breaking the rings only after the adjacent radially inward ring has been broken, the bending movement is directly applied only to the ring to break it without interference or restraining force from other rings radially inwardly positioned therefrom. By breaking the rings radially toward the center of the bore hole, the material from the rings is easily and conveniently removed by the wash fluid from the bore hole. The tendency for downhole deviation is reduced due to cutting the drill face material on the different axial levels and cutting the slots in the drill face material. The slots tend to funnel or confine the advancement of the drill bit along its anticipated axis. The breaker wheels supplying radially inwardly directed force to the annular rings at the three cones equally spaced at radial positions around the axis of the bore hole, tends to confine the drill bit to the desired bore hole axis by following a predetermined helical path defined by the slots formed by the cutting jets.

The absence of large axial forces on the drill bit increases bearing life since the bearings supporting the breaker wheels are not required to withstand the high axial force. Increasing bearing life increases the life of the bit. By positioning the nozzle means of each cone radially outwardly adjacent a breaker wheel, the standoff distance or distance between the drill face material and the nozzle means is kept at a minimum. It is apparent from FIGS. 12-A through 12-O that as the breaker wheels remove an annular ring at one axial level, the nozzle means radially outward positioned from that breaker wheel is in close contact with the drill face material at a less axially advanced level, thereby causing the jets to be highly effective in cutting the drill face material.

Although the present invention has been described with a certain degree of particularity, it is understood that the present disclosure has been made by way of example and that changes in details in structure may be made without departing from the spirit and scope of the invention expressed in the appended claims.

I claim:

1. A rotary drill bit for cutting an axially advancing bore hole by rotation at a drill face of the bore hole, comprising:

a drill bit body, said drill bit body comprising a plurality of axle shafts extending radially toward the axis of rotation of said drill bit;

at least one breaking wheel attached for rotation on each axle shaft to traverse a path concentric with the axis of rotation of said drill bit when rotated in contact with the drill face of the bore hole, at least a few of said breaking wheels are positioned to traverse essentially different paths concentric with the axis of rotation, and fluid jet means, positioned on said drill bit body radially adjacent at least one breaking wheel, for cutting a plurality of different concentric slots concentric with the axis of rotation when said drill bit is rotated, each pair of radially adjacent concentric slots defining edges of one concentric path traversed by at least one breaking wheel.

2. A rotary drill bit as recited in claim 1 wherein:

the concentric path least radially spaced from the axis of rotation is more axially spaced in the axial direction of advancement of the bore hole than the concentric path most radially spaced from the axis of rotation.

3. A rotary drill bit as recited in claim 1 wherein:

said breaking wheels are positioned to contact the drill face of said bore hole at a plurality of different axially spaced levels.

4. A rotary drill bit as recited in claim 1 wherein:

each pair of radially adjacent concentric slots cut in the drill face material define one ring of material, and each breaking wheel primarily initially contacts one ring at an edge thereof.

5. A rotary drill bit as recited in claim 4 wherein:

each breaking wheel applies a tensional force to the material of the ring.

6. A rotary drill bit as recited in claim 1 further comprising:

additional fluid jet means positioned on said drill bit body for cutting a center core opening in the drill face of said bore hole when said drill bit is rotated.

7. A rotary drill bit as recited in claim 6 wherein:

said drill bit body comprises at least one axle shaft for receiving at least one breaking wheel thereon for rotation, and said additional fluid jet means is positioned on one of said axle shafts.

8. A rotary drill bit as recited in claim 7 wherein:

said additional fluid jet means comprises a nozzle means for emitting a jet of fluid; and said nozzle means is positioned essentially in said axle shaft to emit the jet of fluid crossing the axis of rotation of said drill bit at a predetermined angle.

9. In a rotary drill bit for cutting an axially advancing bore hole in material when rotated, said drill bit including rotatable rock breaking means rotationally connected to said drill bit for breaking material, an improvement comprising, in combination:

means adapted for emitting pressurized fluid to cut a center core opening of the bore hole in the material about the bore hole axis with rotation of said drill bit, said center core opening being of substantial radial width and extending outward to a position generally next radially adjacent the innermost operative position of said rotatable rock breaking means, the pressurized fluid emitted further cutting the center core opening to a more axially advanced level than the level at which said rotatable rock breaking means are operative.

10. An invention as recited in claim 9 wherein said means is adapted to emit fluid generally in the form of a jet, the emitted jet of fluid being angled with respect to the axis of rotation of said drill bit.

11. An invention as recited in claim 10 wherein the emitted jet of fluid crosses the axis of rotation of said drill bit.

12. An invention as recited in claim 9 further comprising means for emitting fluid adapted to cut at least one slot generally concentric with the center core opening in the drill face material annularly surrounding the center core opening.

13. An invention as recited in claim 12 wherein said means for emitting fluid are adapted to cut at least two slots generally concentric with the center core opening, the two slots being radially and axially spaced with respect to one another.

14. An invention as recited in claim 9 in which the rock breaking means are of the type which comprise a plurality of rotatable breaker wheels positioned on said drill bit in an arrangement defining generally a frustroconical shape, and wherein:

said means for emitting fluid is positioned generally at one end of the frustroconically shaped arrangement of breaker wheels.

15. An invention as recited in claim 14 wherein said fluid emitting means emits fluid generally in the form of a jet, and the jet is emitted generally parallel with the axis of rotation of one breaker wheel defining one frustroconically shaped arrangement.

16. An invention as recited in claim 15 wherein the emitted jet of fluid crosses the axis of rotation of said drill bit.

17. A rotary drill bit for forming an axially advancing cylindrical bore hole through earth material when rotated at the drill face of the bore hole, comprising:

means adapted for cutting and defining a center core opening in the material at the drill face about the axis of said bore hole, first slot cutting means adapted for cutting a first circular slot in the material concentric with the axis of said bore hole radially adjacent the center core opening, first ring breaking means adapted for breaking substantially only the material between the center core opening and the first circular slot after the center core opening and first circular slot have been cut, said first ring breaking means breaking the material generally radially inward toward the axis of said bore hole, second slot cutting means adapted for cutting a second circular slot in the material concentric with the axis of the bore hole and next radially outwardly spaced from said first circular slot, and second ring breaking means adapted for breaking substantially only the material between the first and second circular slots after the second circular slot has been cut and after the material between the center core opening and the first slot has been broken, said second ring breaking means breaking the material generally radially inward.

18. A rotary drill bit as recited in claim 17 wherein:

said second slot cutting means are operative at approximately the same rotational position of said drill bit as said first breaking means.

19. A rotary drill bit as recited in claim 17 further comprising:

third slot cutting means adapted for cutting a third circular slot in the material concentric with the axis of the bore hole and next radially outward spaced from said second circular slot, and third ring breaking means adapted for breaking substantially only the material between the second and third circular slots after the third circular slot has been cut and after the material between the first and second slots has been broken, said third ring breaking means breaking the material generally radially inward.

20. A rotary drill bit as recited in claim 19 wherein:

said second, third and first slot cutting means are operative, respectively, at approximately the same rotational positions as said first, second and third ring breaking means.

21. A rotary drill bit as recited in claim 19 wherein:

said cutting and breaking means achieve the aforesaid functions with one rotation of said drill bit.

22. A rotary drill bit as recited in claim 21 further comprising:

fourth slot cutting means adapted for cutting a fourth circular slot concentric with the axis of said bore hole and next radially outward spaced from the third slot, and for cutting the fourth slot axially displaced from the first concentric slot cut by approximately the distance of advancement of the bore hole with one revolution of said drill bit; and fourth ring breaking means adapted for breaking substantially only the material between the third and fourth circulr slots after the fourth circulr slot has been cut and after the material between the second and third slots has been broken, said fifth ring breaking means breaking the material generally radially inward.

23. A rotary drill bit as recited in claim 22 wherein:

said fourth slot cutting means are operative at approximately the same radial position as said first slot cutting means.

24. A rotary drill bit as recited in claim 22 wherein:

said fourth breaking means are axially displaced in an operative position from said first ring breaking means by approximately the distance of advancement of the bore hole with one revolution of said drill bit.

25. A rotary drill bit as recited in claim 24 further comprising:

fifth slot cutting means adapted for cutting a fifth circular slot concentric with the axis of the bore hole and next radially outwardly spaced from the fourth slot, and for cutting the fifth slot axially displaced from the second slot cut by approximately the distance of advancement of the bore hole with one revolution of said drill bit;

fifth ring breaking means adapted for breaking substantially only the material between the fourth and fifth circular slots after the fifth circular slot has been cut and after the material between the third and fourth slots has been broken, said fifth ring breaking means breaking the material generally radially inward;

sixth slot cutting means adapted for cutting a sixth slot concentric with the axis of the bore hole and next radially outwardly spaced with the fifth circular slot, and for cutting the sixth slot axially displaced from the third slot by approximately the distance of advancement of the bore hole with one revolution of said drill bit; and sixth ring breaking means adapted for breaking substantially only material between the fifth and sixth slots after the sixth slot has been cut and after the material between the fourth and fifth slots has been broken, said sixth ring breaking means breaking the material generally radially inwardly.

26. A rotary drill bit as recited in claim 25 wherein:

said fifth and sixth breaking means are axially displaced in an operative position from said second and third breaking means, respectively, by approximately the distance of advancement of the bore hole with one revolution of said drill bit.

27. A rotary drill bit as recited in claim 26 wherein:

said second, third and first slot cutting means are operative, respectively, at approximately the same rotational positions as said first, second and third ring breaking means; and said fourth, fifth and sixth slot cutting means are operative, respectively, at approximately the same rotational positions as said third, fourth and fifth ring breaking means.

28. A rotary drill bit as recited in claim 27 wherein:

said first and fourth breaking means are operative at approximately the same rotational positions, said second and fifth breaking means are operative at approximately the same rotational positions, and said third and sixth breaking means are operative at approximately the same rotational positions.

29. A rotary drill bit adapted for cutting an axially advancing cylindrical bore hole through material when rotated at a drill face of the material, comprising:

first means adapted for emitting a fluid jet of sufficient energy for removing material from the drill face to define a center core opening, said first means being operative with rotation of said drill bit, the center core opening being essentially concentric with the axis of the bore hole and extending radially outward from the bore hole axis a distance less than the radius of the bore hole, said first means continuously advancing the center core opening generally in the direction of advancement of the bore hole said first means emitting the fluid jet to intersect the axis of the bore hole at a predetermined acute angle, the predetermined acute angle and the position on said drill bit from which said fluid jet is emitted orienting said fluid jet for removing substantially more material from the drill face at a position generally diametrically opposite said first means than the amount of material removed between the bore hole axis and said first means; and second means adapted for removing material from the drill face defining a first annular segment, said second means being operative with rotation of said drill bit, the first annular segment being next radially adjacent the center opening core and extending radially outward from the outer periphery of the center core opening, said second means continuously removing the material of the first annular segment after said center core opening has been removed, the first annular segment being removed from axial positions generally less axially advanced in the direction of bore hole advancement than the maximum axial advancement of the center core opening.

30. A rotary drill bit as recited in claim 29 wherein said first and second means are adapted for helically removing material to advance the center core opening and first annular segment, respectively.

31. A rotary drill bit as recited in claim 29 wherein the first annular segment extends radially outward to an outer position radially short of the outer periphery of the bore hole, and said drill bit further comprises:

third means adapted for removing material from the drill face defining a second annular segment, said third means being operative with rotation of said drill bit, the second annular segment being next radially adjacent the first annular segment and extending radially outward from a position at the outer periphery of the first annular segment to a position at the outer periphery of the bore hole, said third means continuously removing the material about axial positions less axially advanced in the direction of advancement of the bore hole than the axial positions of the first annular segment.

32. A rotary drill bit as recited in claim 31 wherein said first, second and third means are adapted for helically removing material to advance the center core opening, the first annular segment and the second annular segment, respectively, in the axial direction with each revolution of said drill bit.

33. A rotary drill bit as recited in claim 31 wherein the axial distance separating said second and said third means is adapted to be approximately the distance of axial advancement of said drill bit with one revolution of said drill bit.

34. A rotary drill bit as recited in claim 31 wherein said second and third means each comprise means for emitting at least one jet of fluid.

35. A rotary drill bit as recited in claim 34 wherein said second and third means each further comprise mechanical means for breaking material from the drill face.

36. A rotary drill bit as recited in claim 35 wherein, with respect to each of said second and said third means:

said fluid jet emitting means cut a plurality of concentric slots in each annular segment and thereby define a plurality of rings of material in each annular segment, and said mechanical breaking means break the material of each annular ring.

37. A rotary drill bit as recited in claim 36 wherein said mechanical breaking means break the material of a radially inward ring of each annular segment prior to breaking the material of the next adjacent radially outer ring of that annular segment.

38. A rotary drill bit for forming an axially advancing bore hole in earth material when rotated at a drill face of the bore hole, comprising:

means for cutting a center core opening in the material at the drill face about the axis of rotation when said drill bit is rotated;

means for cutting a plurality of radially spaced concentric slots at positions radially spaced from the center core opening in the material annularly surrounding the center core opening; and means for applying a substantial component of radially inward directed force essentially only to the outer radial edge of each segment of material defined between the center core opening and the radially adjacent slots.

39. A rotary drill bit as recited in claim 38 further comprising:

means, associated with said means for applying radially inward force to the material between the center core opening and the first slot most radially adjacent the center core opening, for breaking the material between the center core opening and the first slot most radially adjacent the center core opening.

40. A rotary drill bit as recited in claim 39 further comprising:

means, associated with said means for applying radially inward force to the material between the two concentric slots most radially adjacent the center core opening, for breaking the material between the two concentric slots most radially adjacent the center core opening after the material between the center core opening and the slot most radially adjacent the center core opening has been broken.

41. A rotary drill bit as defined in claim 39 wherein:

each pair of radially adjacent slots defines a ring of material at the drill face of the bore hole; and said cutting means cuts a circular slot next radially outwardly adjacent from the ring of material being broken by said breaking means.

42. A rotary drill bit as recited in claim 38 further comprising:

means, associated with said means for applying force at the outer radial edge of each ring, for fracturing each ring generally radially inward by a bending movement.

43. A rotary drill bit as recited in claim 42 wherein:

said slot cutting means cut at least one concentric slot at an axial position more advanced in the direction of advancement of the bore hole than the axial position of another concentric slot spaced radially outwardly from the one slot first aforesaid herein.

44. A rotary drill bit for cutting an axially advancing bore hole by rotation at a drill face of the bore hole, comprising:

a drill bit body having at least one radially extending axle shaft member, at least two wheel members operatively attached for rotation on each said axle shaft member, and fluid jet means positioned on said axle shaft member intermediate said two wheel members and adapted for emitting a jet of fluid to cut a slot in the drill face of the bore hole during rotation of said drill bit.

45. A rotary drill bit as recited in claim 44 wherein said two wheel members are positioned on said axle shaft member with adjacent radial portions thereof separated by a distance slightly greater than width of the jet of fluid emitted from said fluid jet means.

46. A rotary drill bit as recited in claim 44 wherein said fluid jet means is axially spaced closely adjacent the bore hole drill face.

47. A rotary drill bit as recited in claim 44 wherein:

each axle shaft member is angled with respect to the axis of rotation of said drill bit, and the radially inner one of the two wheel members is positioned for operation at the bore hole drill face at a different axial position than the radially outer one of the two wheel members.

48. A rotary drill bit as recited in claim 47 wherein the radial inner wheel member is positioned more axially advanced in the direction which said drill bit is adapted for cutting than the radial outer wheel member.

49. A rotary drill bit as recited in claim 44 wherein each axle shaft member terminates radially short of the axis of rotation of said drill bit, and said drill bit further comprises:

central fluid jet means positioned at the inner radial end of one axle shaft member and adapted for emitting a jet of fluid to cut a center core opening in the drill face of the bore hole during rotation of said drill bit.

50. A rotary drill bit as recited in claim 49 wherein:

said central fluid jet means is received essentially within the axle shaft member.

51. A rotary drill bit as recited in claim 49 wherein said central fluid jet means emits the jet of fluid in a direction generally parallel to the axis of rotation of the two wheel members positioned on the axle shaft member receiving said central fluid jet means.

52. A rotary drill bit as recited in claim 49 further comprising:

outer fluid jet means, in addition to said central fluid jet means, positioned on said drill bit body for emitting a jet of fluid to cut the drill face of the bore hole generally around the outer periphery of the bore hole during rotation of the drill bit.

53. A rotary drill bit as recited in claim 52 wherein said outer fluid jet means are positioned at the outer radial edge of one axle shaft member.

54. A rotary drill bit for cutting a bore hole in material, comprising:

means positioned on said drill bit for emitting a jet of high pressure fluid which passes essentially at an acute angle with respect to the axis about which said drill bit is rotatable and which is adapted to cut an opening about the axis of a bore hole drill face, said emitted fluid jet cutting the majority of the material from the drill face at a position generally diametrically opposite the position of said emitting means with respect to the rotational axis of said drill bit; and means adapted for rotating said drill bit.

55. A rotary drill bit as recited in claim 54 wherein the jet of high pressure fluid passes at an acute angle essentially through the axis about which said drill bit rotates.

56. A rotary drill bit as recited in claim 54 further including:

breaking means adapted for breaking material of the drill face bore hole annularly surrounding the center core opening.

57. A rotary drill bit as recited in claim 56 wherein said breaking means comprise at least one breaking wheel positioned for rotation on said drill bit.

58. A rotary drill bit as recited in claim 56 further including means for emitting at least one additional jet of high pressure fluid to cut at least one slot in the drill face material concentric with the axis of the bore hole and radially spaced from the center core opening.

59. A rotary drill bit as recited in claim 58 wherein said breaking means are positioned to engage a portion of each concentric slot cut in the drill face material.

60. A rotary drill bit for cutting an axially advancing bore hole through material when rotated, comprising:

a drill bit body;

three projection members extending generally axially from said bit body at the outer periphery of said drill bit body, said three projection members being essentially spaced at equal radial positions from one another about the axis of said drill bit;

one axle shaft attached to and extending radially inward from each projection member, said axle shafts essentially extending at equal radial angles from one another about the axis of said drill bit, at least one wheel member received on each axle shaft for rotation thereabout; and nozzle means positioned essentially in at least one of said axle shafts and adapted for emitting a jet of pressurized fluid to cut the bore hole material concentric with the axis of rotation when said drill bit is rotated, wherein said nozzle means are adapted to cut at least one slot in the bore hole material generally adjacent the outer periphery of the bore hole.

61. A rotary drill bit as recited in claim 60 wherein said nozzle means are adapted to cut at least one slot in the bore hole material radially intermediate the center core opening and the slot adjacent the outer periphery of the bore hole.

62. A rotary drill bit as recited in claim 60 wherein said nozzle means are adapted to cut a center core opening in the bore hole material about the axis of said bore hole.

63. A rotary drill bit as recited in claim 62 wherein one jet of pressurized fluid emitted from said nozzle means essentially crosses the axis of rotation of said drill bit.

64. A rotary drill bit as recited in claim 62 wherein:

each axle shaft terminates radially short of the axis of rotation of said drill bit, and said nozzle means are positioned adjacent the radially inner termination of at least one of said axle shafts.

65. A rotary drill bit as recited in claim 64 wherein said nozzle means adjacent the radially inner termination of at least one of said axle shafts emits at least one jet of pressurized fluid which essentially crosses the axis of rotation of said drill bit.

66. A rotary drill bit for cutting an axially advancing bore hole through material when rotated, comprising:

a drill bit body;

three projection members extending generally axially from said bit body at the outer periphery of said drill bit body, said three projection members being essentially spaced at equal radial positions from one another about the axis of said drill bit;

one axle shaft attached to and extending radially inward from each projection member, said axle shafts essentially extending at equal radial angles from one another about the axis of said drill bit, at least one wheel member received on each axle shaft for rotation thereabout;

nozzle means positioned essentially in at least one of said axle shafts and adapted for emitting a jet of pressurized fluid to cut the bore hole material concentric with the axis of rotation when said drill bit is rotated;

at least one axle shaft receives two wheel members thereon, and nozzle means are positioned intermediate the two wheel members on at least one axle shaft which receives two wheel members.

67. A rotary drill bit as recited in claim 66 wherein:

each of said axle shafts terminates radially short of the axis of said drill bit, and nozzle means are additionally positioned adjacent the radially inner termination of at least one of said axle shafts.

68. A rotary drill bit as recited in claim 67 wherein:

said wheel members are positioned on said axle shafts for contacting the bore hole material at different positions radially spaced from the axis of the bore hole.

69. A rotary drill bit as recited in claim 68 wherein:

each wheel member contacts the bore hole material at a different radially spaced position than the other wheel members.

70. A method of forming a cylindrically shaped and axially extending bore hole as recited in claim 95, comprising the steps of:

cutting the opening in the material concentric with the axis of the bore hole during rotation of said drill bit, said opening being a center core opening, axially advancing the center core opening to a more advanced axial level in a continuous helical manner with each revolution of said drill bit, and removing the center core opening subsequent to cutting the center core opening.

71. A method as recited in claim 70 wherein said step of removing material of the drill face annularly surrounding the center core opening further comprises:

forming the material surrounding the center core into concentric rings, and removing concentric rings of the material.

72. A method as recited in claim 71 further comprising:

removing the concentric rings in sequence, beginning with the ring most radially inward and sequentially progressing to the most radially outward ring.

73. A method as recited in claim 71 further comprising:

cutting slots in the material to define each concentric ring prior to removing the rings.

74. A method as recited in claim 73 further comprising:

emitting jets of fluid to cut the slots in the material.

75. A method as recited in claim 74 further comprising:

contacting mechanical means with each ring to remove each ring.

76. A method as recited in claim 70 wherein said step of removing material of the drill face annularly surrounding the center core opening further comprises:

separating the material annularly surrounding the center core opening into a first annular segment and a second annular segment, the first annular segment being next radially adjacent the center core opening and extending radially outward from the outer periphery of the center core opening to an outer position radially short of the outer periphery of the bore hole, the second annular segment being next radially adjacent the first annular segment and extending radially outward from the outer periphery of the first annular segment to a position at the outer periphery of the bore hole, and removing the first annular segment at a selected axial level prior to removing the second annular segment at that selected axial level.

77. A method as recited in claim 76 further comprising:

removing the second annular segment during the next subsequent revolution of said drill bit after removal of the first annular segment.

78. A method as recited in claim 76 further comprising:

removing the first annular segment at a first selected axial level, and simultaneously removing the second annular segment at a second selected axial level, the first and second selected axial levels being axially spaced by approximately the distance of axial advancement of said drill bit during one revolution, the second selected axial level being less axially advanced than the first selected axial level.

79. A method as recited in claim 76 wherein the steps of removing the first and second annular segments comprise:

forming each annular segment into concentric rings of material, and removing concentric rings of material from each annular segment.

80. A method as recited in claim 79 further comprising, with respect to each annular segment:

removing the concentric rings in sequence, beginning with the ring most radially inward and sequentially progressing to the most radially outward ring.

81. A method as recited in claim 79 further comprising:

cutting slots in the material to define each concentric ring prior to removing the rings.

82. A method of forming an opening through material by rotation of a drill bit at a drill face of a bore hole, comprising steps of:

emitting a single fluid jet from a predetermined position on said drill bit, said fluid jet being of sufficient energy to cut the material, the predetermined position being radially spaced from the rotational axis of said drill bit;

angling the single emitted fluid jet from the predetermined position axially in the direction of advancement of the drill bit and radially inward to intersect and pass substantially through the rotational axis of said drill bit;

cutting substantially more material with said fluid jet from the radial side of said drill face diametrically opposite the predetermined position than the amount of material cut from the drill face on the radial side between the rotational axis and the predetermined position, and rotating said drill bit.

* * * * *